United States Patent [19]

Liu et al.

[11] Patent Number: 4,711,761

[45] Date of Patent: Dec. 8, 1987

[54] DUCTILE ALUMINIDE ALLOYS FOR HIGH TEMPERATURE APPLICATIONS

[75] Inventors: Chain T. Liu; Carl C. Koch, both of Oak Ridge, Tenn.

[73] Assignee: Martin Marietta Energy Systems, Inc., Oak Ridge, Tenn.

[21] Appl. No.: 519,941

[22] Filed: Aug. 3, 1983

[51] Int. Cl.[4] ..... C22C 19/00

[52] U.S. Cl. ..... 420/459

[58] Field of Search ..... 420/445, 459, 460; 148/429

[56] References Cited

U.S. PATENT DOCUMENTS 4,478,791 10/1984 Huang et al. ..... 420/445

OTHER PUBLICATIONS

Aoki et al, Nippon Kinzoku Gakkaishi, 43, p. 1190, 1979.

*Primary Examiner*—R. Dean

[57] ABSTRACT

Alloys are described which contain nickel, aluminum, boron, iron and in some instances manganese, niobium and titanium.

5 Claims, 1 Drawing Figure

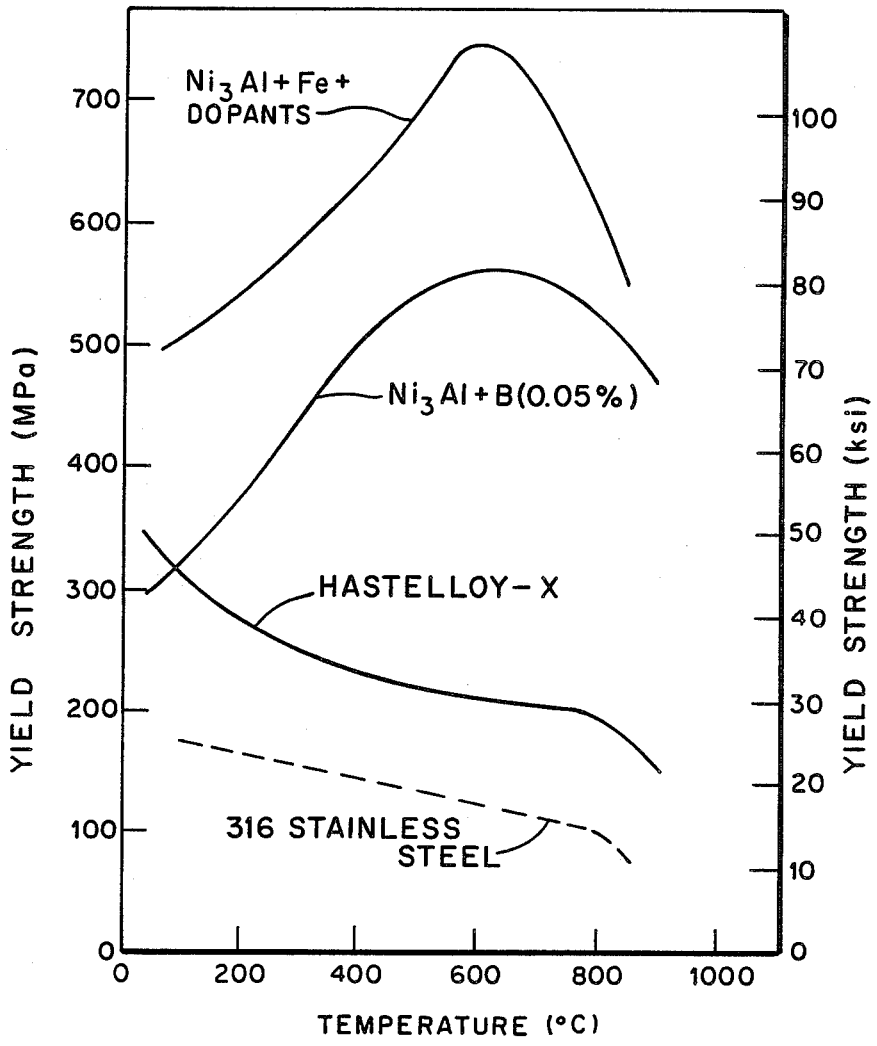
Ni3Al+Fe+
DOPANTS
Ni3Al+B(0.05%)
HASTELLOY-X
316 STAINLESS
STEEL
YIELD STRENGTH (MPa)
YIELD STRENGTH (ksi)
TEMPERATURE (°C)
0
100
200
300
400
500
600
700
10
20
30
40
50
60
70
80
90
100
0
200
400
600
800
1000

DUCTILE ALUMINIDE ALLOYS FOR HIGH TEMPERATURE APPLICATIONS

This invention, which resulted from a contract with the United States Department of Energy, relates to heat and corrosion resistant alloys containing nickel, aluminum, boron, iron, and in some species, manganese, niobium and titanium.

Because of the limited availability and strategic nature of chromium, there has been an increasing interest in the development of strong, heat and corrosion resistant alloys for use as substitutes for the many chromium-containing ferrous alloys commonly referred to as stainless steels. Some nickel and iron aluminides have been found to maintain high strength and resist oxidation at elevated temperatures. Although single crystals of $Ni_3Al$ are known to be ductile, polycrystalline forms of the intermetallic compound are extremely brittle and therefore cannot be used to form sheetmetal products. However, it has been reported recently by Aoki and Izumi in *Nippon Kinzoku Gakkaishi,* Volume 43, Number 12, that the addition of a small amount of boron can reduce the brittleness of $Ni_3Al$.

SUMMARY OF THE INVENTION

It is an object of this invention to provide improved alloys of the type containing aluminum, nickel and boron.

Another object of this invention is to provide alloys which have higher yield strength, better ductility, and better fabricability than the alloys of the type which have been reported by Aoki and Izumi in the aforementioned publication and which contain only aluminum, nickel and a boron dopant.

These objects are achieved by preferred embodiments of the invention wherein iron is included in alloys containing aluminum, nickel and boron. In some instances, small amounts of manganese, niobium and titanium are also advantageously added to compositions containing aluminum, nickel, boron and iron.

DESCRIPTION OF THE DRAWING

The single drawing is a graph showing the yield strengths of 316 Stainless Steel, Hastelloy X, $Ni_3Al$ containing only boron as an additive, and an alloy in accordance with the invention which contains $Ni_3Al$, boron and iron.

DETAILED DESCRIPTION OF PREFERRED EMBODIMENTS OF THE INVENTION

Several samples of boron-doped nickel aluminides based on $Ni_3Al$ were alloyed with different amounts of iron. The aluminide alloys were prepared by arc melting and drop casting pure aluminum, iron and a master alloy of nickel, aluminum and boron in proportions which provided the alloy compositions listed in Table I.

TABLE I

| Sample | Composition (Weight %) | Test Results |
|---|---|---|
| 1 | Fe—1.1; Al—12.7; B—0.5; balance Ni | Alloy cracked during sheet fabrication |
| 2 | Fe—1.1; Al—13.0; B—0.05; balance Ni | Alloy cracked during sheet fabrication |
| 3 | Fe—2.2; Al—12.7; B—0.05; balance Ni | Alloy cracked during sheet fabrication |
| 4 | Fe—6.5; Al—11.5; B—0.05; balance Ni | Sheet fabricated without cracking |

TABLE I-continued

| Sample | Composition (Weight %) | Test Results |
|---|---|---|
| 5 | Fe—10.7; Al—10.4; B—0.05; balance Ni | Sheet fabricated without cracking |
| 6 | Fe—15.9; Al—9.0; B—0.05; balance Ni | Sheet fabricated without cracking |
| 7 | Fe—16.1; Al—10.4; B—0.05; balance Ni | Sheet fabricated without cracking |
| 8 | Fe—20.9; Al—7.6; B—0.05; balance Ni | Alloy cracked during sheet fabricaion |

As shown in the table, each composition in this series of alloys contained 0.05 percent boron by weight. Alloy ingots were homogenized at 1,000° C. and fabricated into sheets having a thickness of 0.08 mm by repeated rolling at room temperature and subsequent heat treatment at 1,000° C. The alloys designated 1–3 and 8 in Table I cracked quite extensively during cold rolling while the alloys designated 4–7 were successfully formed into sheets with only minor edge or end cracks. Hence, it was shown by the tests that alloys comprising about 9.0 to about 11.5 weight percent aluminum, about 6.5 to about 16.1 weight percent iron, 0.05 weight percent boron, and a balance of nickel provide good characteristics for fabrication of sheet products.

EXAMPLE II

Another series of aluminide alloy was prepared by the arc melting and drop casting steps described in Example I, with small amounts of manganese, niobium and titanium added to the alloys to improve their fabrication properties. The alloy compositions of this series are listed in Table II.

TABLE II

| Sample | Composition (Weight %) |
|---|---|
| 1 | Fe—10.7; Al—9.8; Mn—0.5; Ti—0.5; B—0.05; balance Ni |
| 2 | Fe—10.7; Al—10.4; Mn—0.5; Ti—0.5; B—0.07; balance Ni |
| 3 | Fe—10.7; Al—10.1; Mn—1.0; Ti—0.5; B—0.05; balance Ni |
| 4 | Fe—10.4; Al—10.3; Mn—0.5; Nb—1.3; B—0.01; balance Ni |
| 5 | Fe—10.4; Al—10.0; Mn—0.5; Nb—1.3; Ti—0.5; B—0.05; balance Ni |

X-ray diffraction revealed the formation of the $L1_2$-type cubic ordered structure (similar to $Cu_3Au$) in these aluminide alloys. The alloy ingots were fabricated into 0.8 mm-thick sheets without cracking by repeated cold rolling and heat treatment at 1,100° C. The amount of cold work was initially about 15% reduction in thickness, and was gradually increased to 40% between each intermediate anneal. Tensile specimens were blanked from the alloy sheets and recrystallized for 30 minutes at 1,000° C. Tensile properties of these alloys were determined as a function of test temperature at a cross-head speed of 2.5 mm/minute. The accompanying graph shows the variation of yield strength with test temperature for B-doped $Ni_3Al$, B-doped $Ni_3Al+Fe$ (IC-14) and the commercial alloys Hastelloy X and type 316 stainless steel. Unlike the conventional alloys, the strength of B-doped $Ni_3Al$ increases with increasing temperature and reaches a maximum at about 600° C. The aluminide is further hardened by the addition of iron as shown. Alloy 3 displayed a yield strength of 750 MPa (110,000 psi), which is more than three times that of Hastelloy X and six times that of type 316 stainless steel at 600° C. Specimens of alloy 3 showed transgranular ductile fracture with a room temperature tensile elongation of 48%, which is distinctly higher than that of B-doped $Ni_3Al$ reported in the aforementioned Aoki and Izumi publication. Alloy 3 specimens only exhibited a slight decrease in ductility with test temperature and had a tensile elongation of 41% at 700° C. The ductility of alloy 3 decreased to a level of 15 to 20% at temperatures above 800° C. The function of adding iron to the $Ni_3Al$ was to lower the nickel concentration, strengthen $Ni_3Al$ by a solid solution hardening effect, and lower the alloy cost. Manganese, niobium and titanium were added to improve the fabricability of the alloy by possibly gettering harmful impurities, such as sulfur, which tend to segregate to grain boundaries in nickel aluminides.

EXAMPLE III

Coupons of the aluminide alloys with and without iron additions were exposed to air at 800° C. for evaluation of their air oxidation. The aluminide alloys were somewhat more oxidation resistant than 300 series stainless steels because of the formation of a protective Al-rich oxide scale on the specimen surface. In addition, the aluminides remained ductile after extensive oxidation in air at 900° C. Metallographic examination showed no indication of oxygen penetration or precipitation of oxides along grain boundaries. These results indicate that the aluminide alloys containing no chromium have excellent oxidation resistance in air at elevated temperatures.

What is claimed is:

1. The method of increasing the strength of a polycrystalline $Ni_3Al$ alloy doped with 0.02 to 0.07 weight percent boron comprising the addition of about 6 to 16 weight percent iron.

2. An alloy consisting essentially of about 9.0 to 11.5 wt.% aluminum, about 6.0 to 16 wt.% iron, about 0.01 to 0.07 wt.% boron, and the balance nickel.

3. An alloy as claimed in claim 2 wherein the alloy contains 0.5 to 1.0 wt.% manganese, and a metal selected from the group consisting of about 0.5 wt.% titanium, about 1.3 wt.% niobium, and the combination thereof.

4. A method for preparing a polycrystalline nickel-aluminum-iron alloy, comprising the steps of forming a melt consisting essentially of about 9.0 to 11.5 wt.% aluminum, about 6.0 to 16 wt.% iron, about 0.01 to 0.07 wt.% boron, and the balance nickel, and cooling the melt to form a solid body of said alloy.

5. The method claimed in claim 4 including the additional step of adding to said melt about 0.5 to 1.0 wt.% manganese and a metal selected from the group consisting of about 0.5 wt.% titanium, about 1.3 wt.% niobium, and the combination thereof.

* * * * *